US007252062B2

(12) United States Patent
Hiramatsu

(10) Patent No.: US 7,252,062 B2
(45) Date of Patent: Aug. 7, 2007

(54) GLOW PLUG ENERGIZATION CONTROL TO AVOID OVERHEATING

(75) Inventor: Hiromi Hiramatsu, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/377,355

(22) Filed: Mar. 17, 2006

(65) Prior Publication Data

US 2006/0207541 A1 Sep. 21, 2006

(30) Foreign Application Priority Data

Mar. 17, 2005 (JP) ..... 2005-076880

(51) Int. Cl.
*F02P 19/00* (2006.01)

(52) U.S. Cl. ..... 123/142.5 E; 123/179.6

(58) Field of Classification Search ..... 123/145 A, 123/142.5 E, 179.6
See application file for complete search history.

(56) References Cited

U.S. PATENT DOCUMENTS 4,516,543 A 5/1985 Abe et al.
5,063,513 A * 11/1991 Shank et al. ..... 123/142.5 E
5,727,384 A * 3/1998 Ma ..... 123/142.5 E
6,009,369 A * 12/1999 Boisvert et al. ..... 123/179.6
6,164,258 A * 12/2000 Petrovich et al. ..... 123/179.6
2005/0081812 A1* 4/2005 Toedter et al. ..... 123/145 A

FOREIGN PATENT DOCUMENTS

| | | |
|---|---|---|
| JP | 54-150528 | 11/1979 |
| JP | 56-129763 | 10/1981 |
| JP | 57-203872 | 12/1982 |
| JP | 59-041673 | 3/1984 |
| JP | 2-146267 | 6/1990 |
| JP | 2004-108189 | 4/2004 |

* cited by examiner

*Primary Examiner*—Erick Solis
(74) *Attorney, Agent, or Firm*—Nixon & Vanderhye P.C.

(57) ABSTRACT

A glow plug energization control apparatus is provided which includes a power supply working to supply electric power to a glow plug mounted in an internal combustion engine, an on-off switch working to produce a control trigger signal when turned on, and a controller including a microcomputer. The microcomputer is responsive to the control trigger signal to control supply of the electric power from the power supply to energize the glow plug. The microcomputer works to monitor an off-on interval from turning off to turning on of the on-off switch and control an amount of energization of the glow plug as a function of the off-on interval, thereby avoiding overheating of the glow plug.

15 Claims, 12 Drawing Sheets

GLOW PLUG ENERGIZATION CONTROL TO AVOID OVERHEATING

CROSS REFERENCE TO RELATED DOCUMENT

The present application claims the benefit of Japanese Patent Application No. 2005-76880 filed on Mar. 17, 2005, the disclosure of which is incorporated herein by reference.

BACKGROUND OF THE INVENTION

1. Technical Field of the Invention

The present invention relates generally to a glow plug energization controlling apparatus which may be employed in automotive vehicle to control energization of a glow plug working to assist in starting an internal combustion engine, and more particularly to such an apparatus equipped with a microcomputer designed to control an operation of a glow plug for avoiding overheating thereof.

2. Background Art

Usually, typical diesel automotive vehicles are equipped with a glow plug working to assist in heating inside a cylinder of a diesel engine up to an ignition temperature of an air-fuel mixture, especially when the outside air temperature is low, and the engine is cold.

In recent years, in order to meet requirements to improve the startability of the engine, engine control systems have been employed which are designed to apply a dc voltage to the glow plug to heat the glow plug to a target temperature quickly. Rough control of an on-duration for which the dc voltage is applied to the glow plug will, thus, result in increase in physical load on the glow plug. For instance, too long the on-duration of the glow plug will result in overheating of the glow plug, which may lead to wire breakage in the glow plug.

In recent years, for the purpose of increasing the accuracy in controlling the energization of the glow plug, glow plug energization control systems have been in widespread use which are equipped with a microcomputer designed to control power supply to the glow plug as well as other controls for the engine. When a key switch of the automotive vehicle is turned on, the electric power is supplied to the microcomputer. The microcomputer applies an effective voltage of 11V to the glow plug in the form of a PWM signal for a given initial energiation duration and then also applies an effective voltage of 7V to keep the glow plug at a target temperature of, for example, 900° C., for a given period of time (will also be referred to as a temperature-holding time below).

The above glow plug energization control systems, however, encounter a drawback in the following situation.

When the key switch is turned off by an operator in the course of energization of the glow plug and then turned on again immediately to reenergize the glow plug, the glow plug starts to be heated from a relatively high temperature. When the glow plug continues to be energized over the initial energization duration and the temperature-holding time, it may cause the glow plug to overheat.

In order to avoid the above problem, Japanese Patent First Publication No. 2004-108189 teaches a glow plug energization control system designed to keep the microcomputer activated after the key switch is turned off until the temperature of the glow plug decreases to a given lower level to calculate an optimum amount of energization of the glow plug which will not result in the overheating of the glow plug when the key switch is turned on immediately. This system, however, requires an electrical circuit which measures the voltage and current given to the glow plug to determine the optimum amount of energization, thus resulting in complexity and increase in production cost of the system.

SUMMARY OF THE INVENTION

It is therefore a principal object of the invention to avoid the disadvantages of the prior art.

It is another object of the invention to provide a simple and inexpensive structure of a glow plug energization control apparatus designed to ensure the stability in energizing a glow plug which is installed in, for example, a diesel engine.

According to one aspect of the invention, there is provided a glow plug energization controlling apparatus which may be employed in diesel automotive vehicle. The apparatus comprises: (a) a power supply working to supply electric power to a glow plug mounted in an internal combustion engine; (b) an on-off switch working to produce a control trigger signal when turned on; and (c) a controller including a microcomputer. The controller is responsive to the control trigger signal to control supply of the electric power from the power supply to energize the glow plug. The microcomputer works to monitor an off-on interval from turning off to turning on of the on-off switch and control an amount of energization of the glow plug as a function of the off-on interval, thereby avoiding overheating of the glow plug.

In the preferred mode of the invention, the microcomputer also monitors an switch on-duration for which the on-off switch is in an on-state and controls the amount of energization of the glow plug as a function of the switch on-duration.

The microcomputer also monitors a temperature parameter indicating a temperature of the engine and controls the amount of energization of the glow plug as a function of the temperature parameter.

The microcomputer stores therein a first map representing an initial energization duration, for which the glow plug is to be energized until a target temperature is reached, defined as a function of the temperature of the engine. The microcomputer determines the initial energization duration by look-up using the first map based on the temperature parameter and energizes the glow plug for the initial energization duration.

The microcomputer stores therein a second map representing a temperature-holding time, for which the target temperature is to be held constant after expiry of the initial energization duration, defined as a function the temperature of the engine. The microcomputer determines the temperature-holding time by look-up using the second map based on the temperature parameter and energizes the glow plug for the temperature-holding time after expiry of the initial energization duration.

If a temperature of the glow plug from which the glow plug is permitted to be energized for the initial energization duration without overheating is defined as an unoverheating temperature, the microcomputer stores therein a cooling time that is a time required by the glow plug to cool from the target temperature to the unoverheating temperature. When the on-off switch is turned off after the glow plug reaches the target temperature, the microcomputer is in a reset mode for the cooling time unless the on-off switch is turned on.

When the on-off switch is turned off and then on after the glow plug reaches the target temperature, the microcomputer calculates a reenergization duration tpr2 for which the glow plug is to be energized according to an equation below $$tpr2=tp\times toff/ts2$$

where tp is the initial energization duration, toff is the off-on interval, and ts2 is the cooling time, and wherein the microcomputer energizes the glow plug for the reenergization duration.

When the on-off switch is turned off before the glow plug reaches the target temperature, the microcomputer calculates a second cooling time ts1 according to an equation below $$ts1=ts2\times ton/tp$$

where ts2 is the cooling time required by the glow plug to cool from the target temperature to the unoverheating temperature, ton is a period of time for which the on-off switch is in the on-state during the initial energization duration, and tp is the initial energization duration, and wherein the microcomputer is in the reset mode for the second cooling time ts1 unless the on-off switch is turned on.

When the on-off switch is turned off and then on before the glow plug reaches the target temperature, the microcomputer calculates a reenergization duration tpr1 for which the glow plug is to be energized according to an equation below $$tpr1=tp\times toff/ts1$$

where tp is the initial energization duration, toff is the off-on interval from turning off to turning on of the on-off switch, and ts1 is the second cooling time, and wherein the microcomputer energizes the glow plug for the reenergization duration tpr1.

According to the second aspect of the invention, there is provided a glow plug energization controlling method of controlling energization of a glow plug mounted in an internal combustion engine which comprises: (a) a first step of sampling a parameter indicating a temperature of the engine upon turning on of an on-off switch designed to produce a control trigger signal when turned on, finding an initial energization during for which the glow plug is to be energized until a target temperature is reached by look-up using a first map representing the initial energization duration defined as a function of the temperature of the engine, energizing the glow plug for the initial energization duration, and keeping the glow plug at the target temperature for a given temperature-holding time after expiry of the initial energization duration; (b) a second step of finding a cooling time ts2 required by the glow plug to cool from the target temperature to an unoverheating temperature from which the glow plug is permitted to be energized for the initial energization duration without overheating, blocking supply of power to the glow plug when the on-off switch is turned off after expiry of the initial energization duration during the first step, and entering a rest mode to place the glow plug in an off-position until expiry of the cooling time ts2 unless the on-off switch is turned on; and (c) a third step of, when the on-off switch is turned on again during the second step, calculating a reenergization duration tpr2 for which the glow plug is to be energized as a function of an off-on interval from turning off to turning on of the on-off switch, energizing the glow plug for the reenergization duration tpr2, and keeping a temperature of the glow plug constant for the temperature-holding time after expiry of the reenergization duration tpr2.

In the preferred mode of the invention, the reenergization duration tpr2 is given by an equation below $$tpr2=tp\times toff/ts2$$

where tp is the initial energization duration, toff is the off-on interval, and ts2 is the cooling time.

The method may further comprise a fourth step of, when the on-off switch is turned off during the first step before expiry of the initial energization duration, sampling the parameter indicating the temperature of the engine, calculating a second cooling time ts1 required by the glow plug to cool to the unoverheating temperature, and entering a rest mode unless the on-off switch is turned off and a fifth step of, when the on-off switch is turned on again during the fourth step, calculating a reenergization duration tpr1 for which the glow plug is to be energized as a function of an on-duration for which the on-off switch is in an on-state during the initial energization duration, energizing the glow plug for the reenergization duration tpr1, and holding the temperature of the glow plug for the temperature-holding time after expiry of the reenergization duration tpr1.

The second cooling time ts1 is given by an equation below $$ts1=ts2\times ton/tp$$

where ts2 is the cooling time required by the glow plug to cool from the target temperature to the unoverheating temperature, ton is the on-duration for which the on-off switch is in the on-state during the initial energization duration, and tp is the initial energization duration.

The reenergization duration tpr1 is given by an equation below $$tpr1=tp\times toff/ts1$$

where tp is the initial energization duration, toff is a time interval from turning off to turning on of the on-off switch, and ts1 is the second cooling time.

The method may also include a fourth step of finding the cooling time ts2 required by the glow plug to cool from the target temperature to the unoverheating temperature and, when the on-off switch is kept on after expiry of the temperature-holding time, deenergizing the glow plug until the cooling time ts2 expires unless the on-off switch is turned off, a fifth step of, when the on-off switch is turned off during the fourth step, entering the rest mode during the cooling time ts2 following the fourth step unless the on-off switch is turned on again, and a sixth step of, when the on-off switch is turned on again during the fifth step, calculating the reenergization duration tpr2 for which the glow plug is to be energized as a function of the off-on interval from turning off to turning on of the on-off switch, and energizing the glow plug for the reenergization duration tpr2.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 9(*b*) is a graph plotting the on-duration of the glow plug, as illustrated in FIG. 9(*a*), which changes as a function of the temperature of coolant of the engine.

DESCRIPTION OF THE PREFERRED EMBODIMENTS

Figure 1:
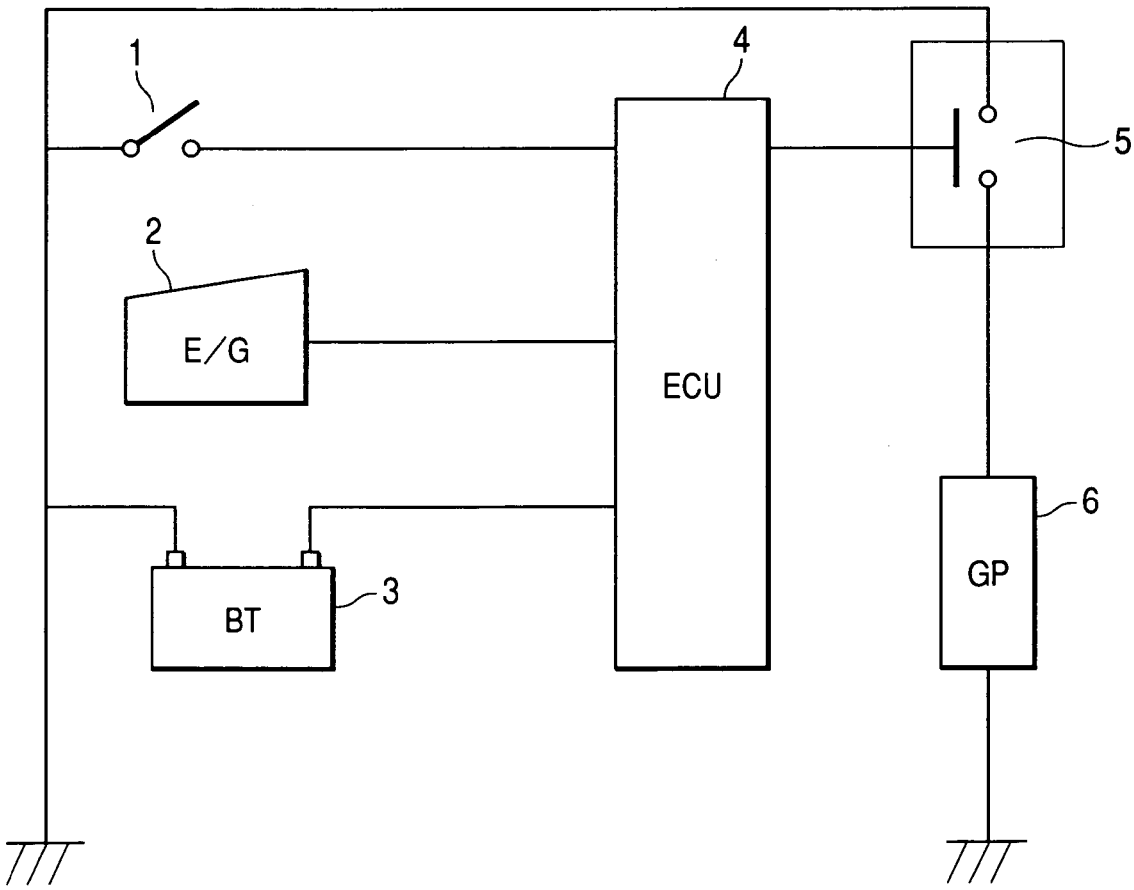
FIG. 1 is a block diagram which shows a glow plug energization controller according to the present invention.

Referring to the drawings, wherein like reference numbers refer to like parts in several views, particularly to FIG. 1, there is shown a glow plug controller according to the invention.

The glow plug controller is mainly constructed by an engine electronic control unit (ECU) 4 equipped with a microcomputer usually installed in an automotive vehicle. The glow plug controller includes a glow plug on-off switching unit 5 equipped with a switch leading to a glow plug 6 installed in a diesel engine 2. The engine ECU 4 is connected to a storage battery 3 and a key switch 1 implemented by an on-off switch such as a typical automotive ignition switch. The glow plug on-off switching unit 5 is so controlled by the ECU 4 that it is opened and closed cyclically for a short period of time and preferably implemented by an electronic switch such as a transistor, a power MOSFET, or a thyristor or a switching circuit including them.

The engine ECU 4 monitors the voltage, as developed by the battery 3, the temperature of the engine 2, and an on-off signal outputted by the key switch 1 and works to control an on-off operation of the glow plug on-off switching unit 5 at given times. When the glow plug on-off switching unit 5 is closed, it will cause the voltage to be applied from the battery 3 to the glow plug 6.

The control of energization of the glow plug 6 is achieved by the engine ECU 4 generally installed in the automotive vehicle, thus eliminating the need for an additional microcomputer. In general, to typical engine ECUs, the battery voltage, the engine temperature, and the on-off state of the ignition switch are inputted to control the operation of the glow plug, thus permitting the glow plug controller of this embodiment to be made at a low cost to have a simple structure.

Figure 2:
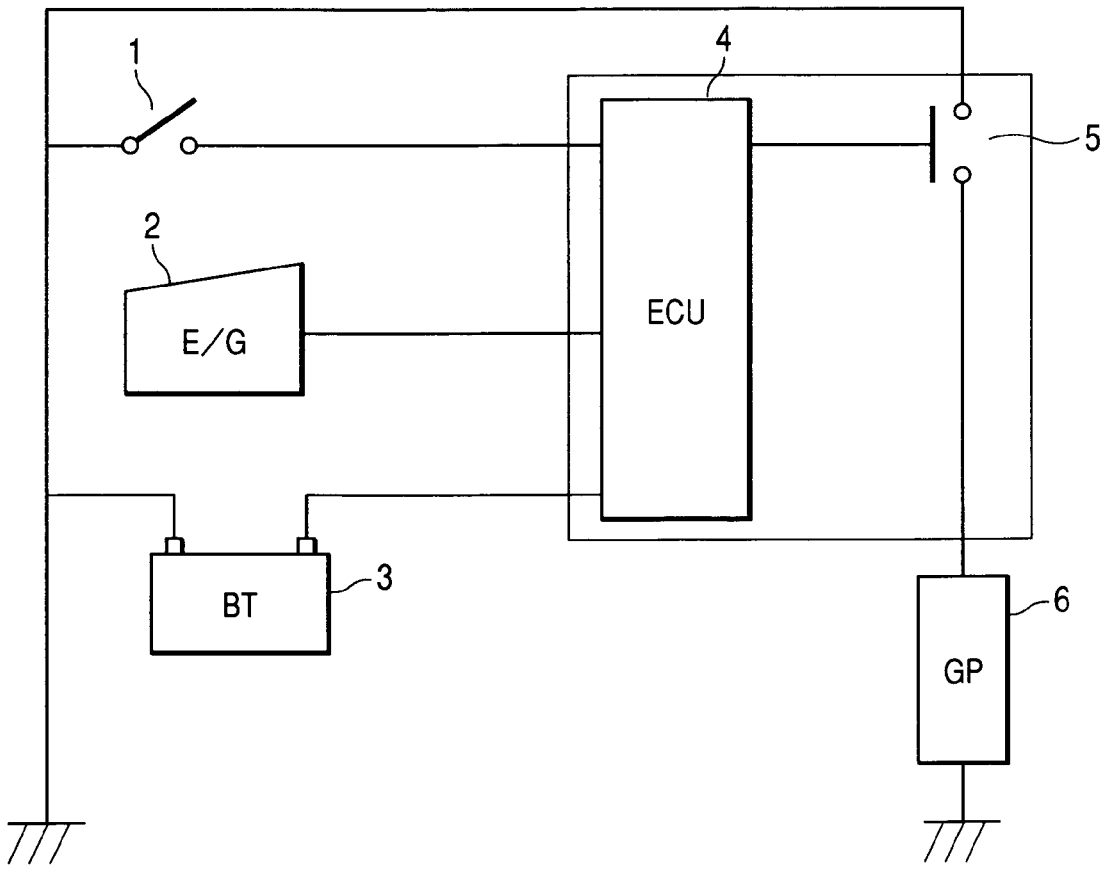
FIG. 2 is a block diagram which shows a modification of the glow plug energization controller of FIG. 1.

The glow plug on-off switching unit 5 may alternatively be, as illustrated in FIG. 2, assembled along with the engine ECU 4 or mounted in the same casing.

Figure 3:
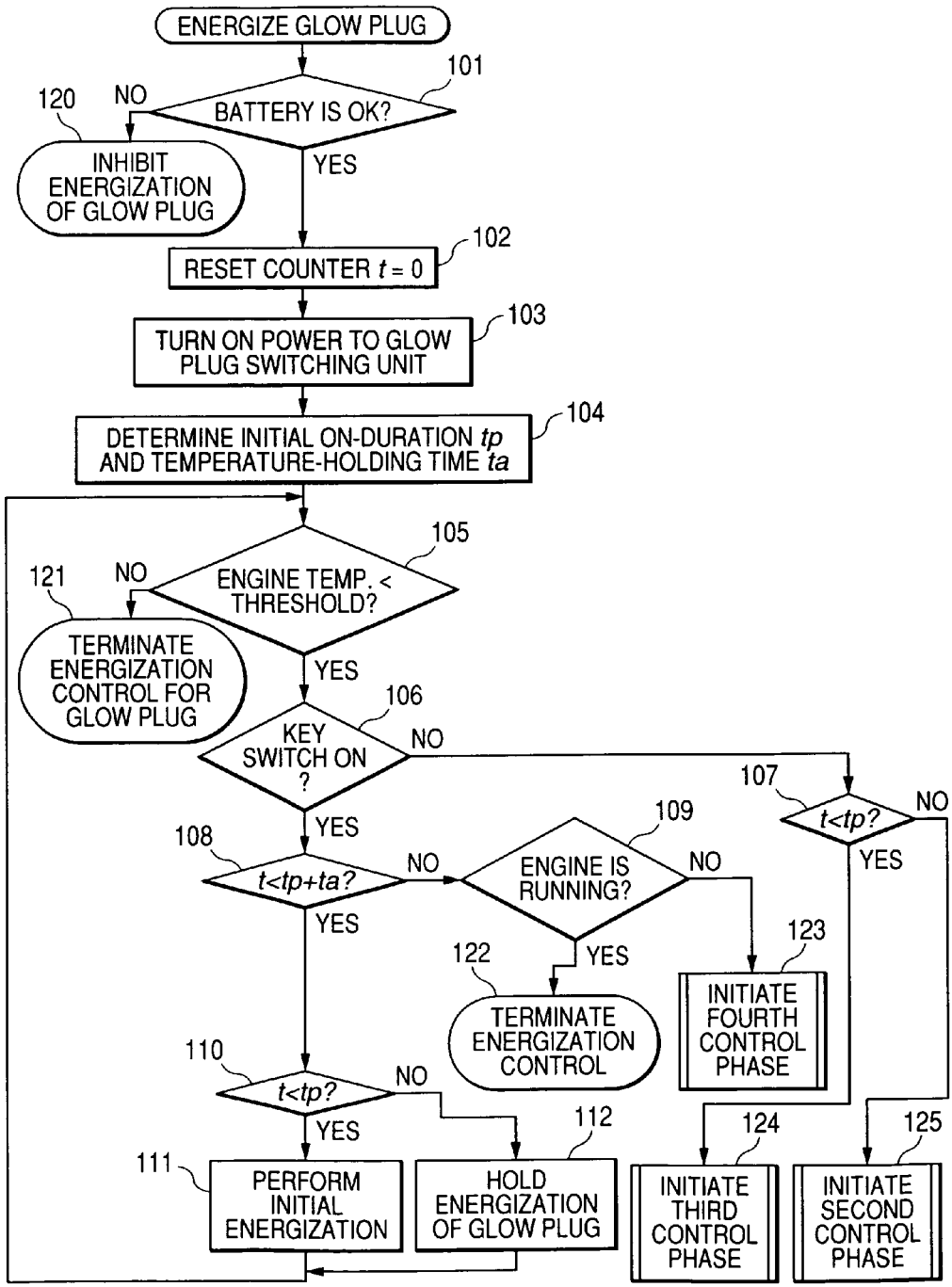
FIG. 3 is a flowchart of a program to be executed by the glow plug energization controller of FIG. 1 to control energization of a glow plug in a first control phase.
Figure 4A:
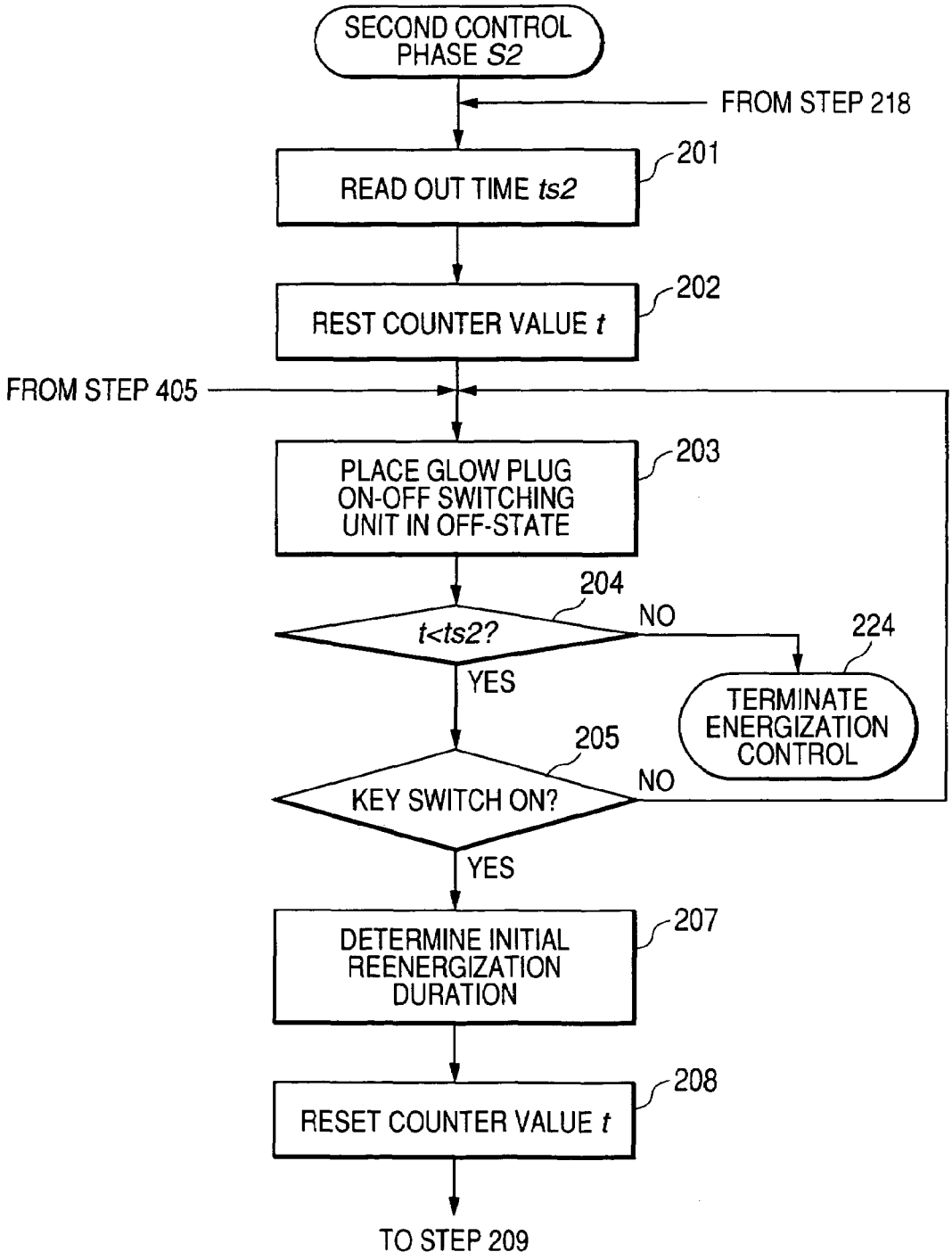
FIGS. 4(*a*) and 4(*b*) show a flowchart of a second control phase to control reenegization of a glow plug after the glow plug reaches a target temperature.
Figure 4B:
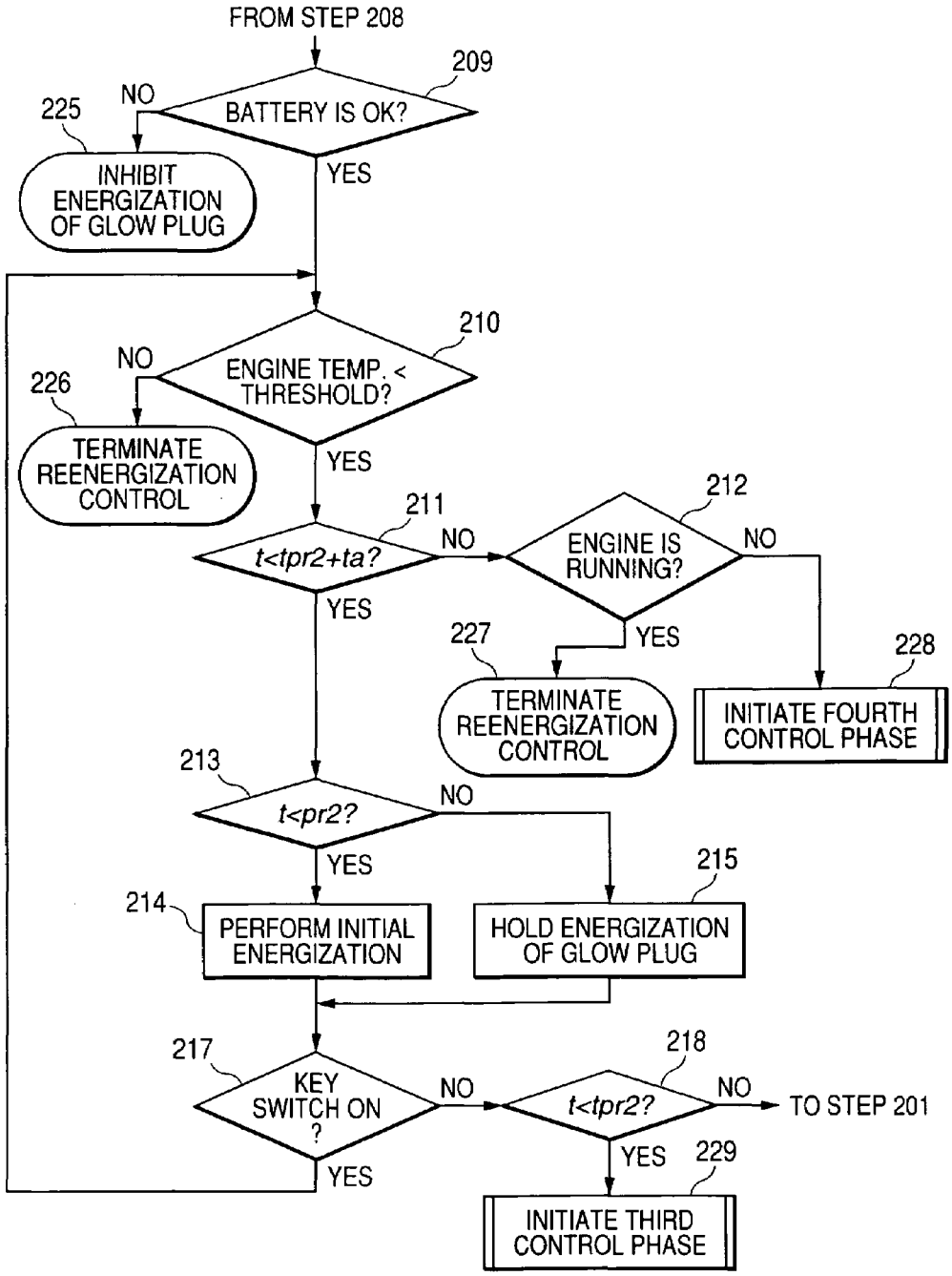
Figure 5A:
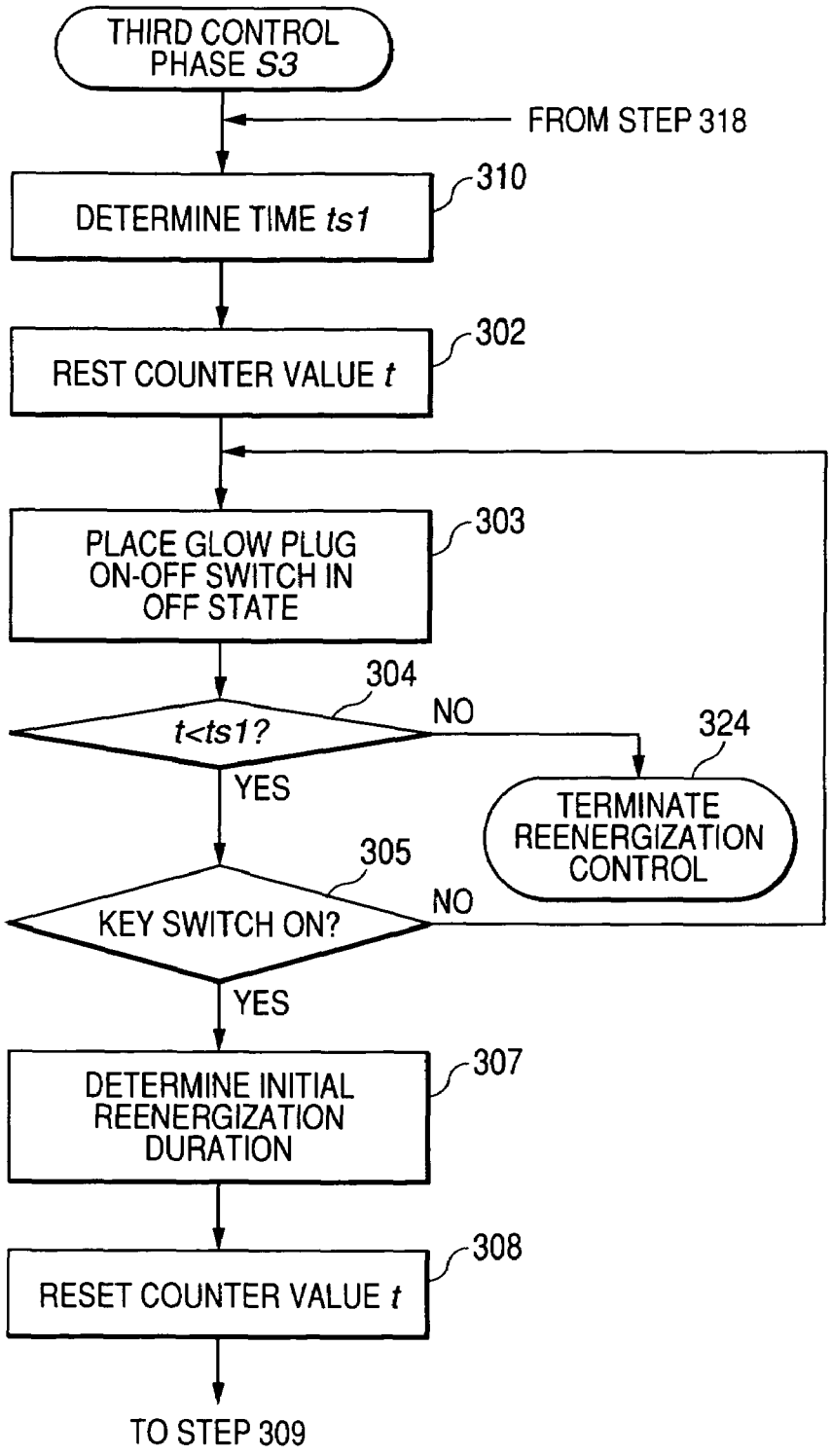
FIGS. 5(*a*) and 5(*b*) show a flowchart of a third control phase to control reenegization of a glow plug before the glow plug reaches a target temperature.
Figure 5B:
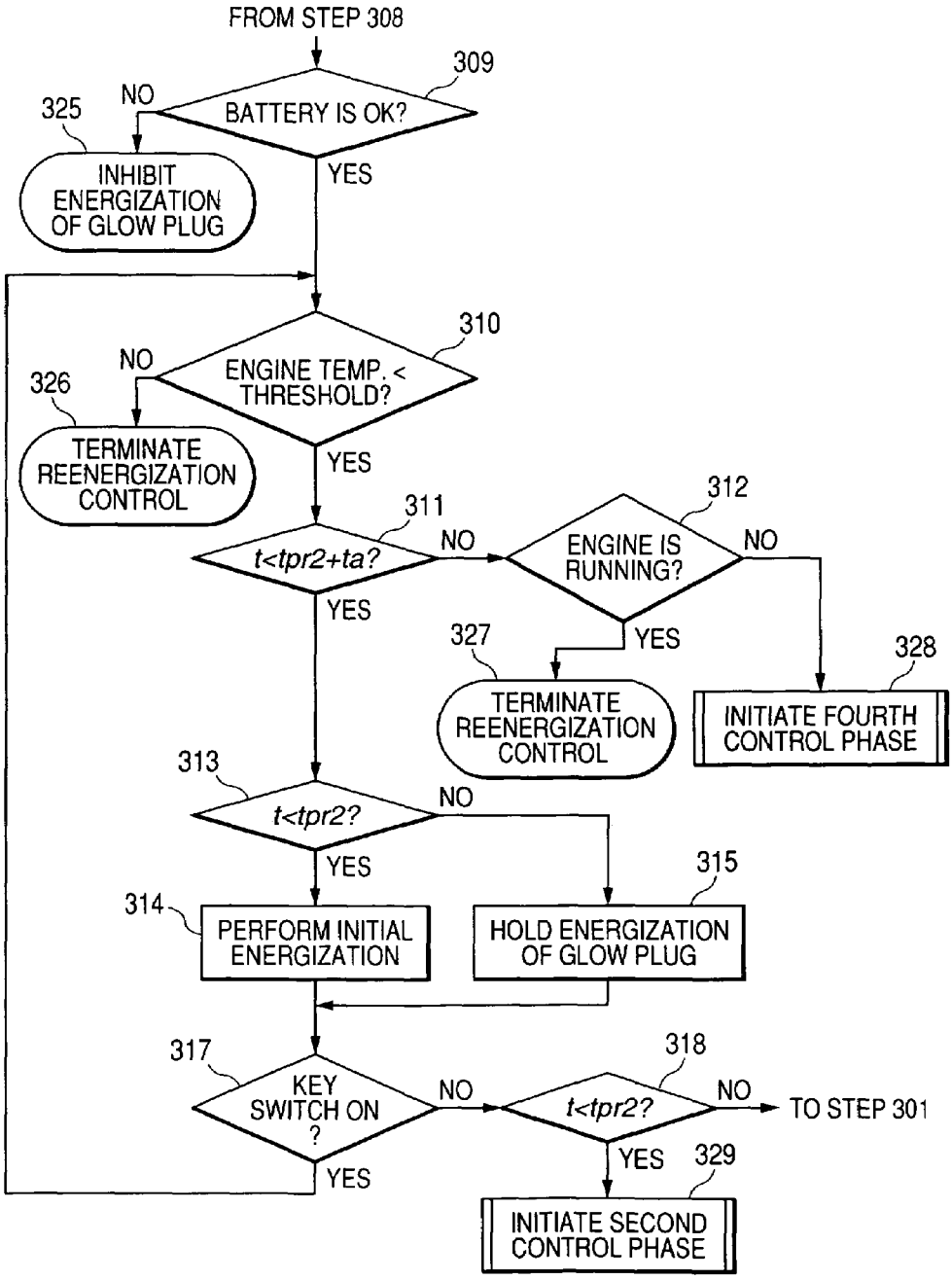
Figure 6:
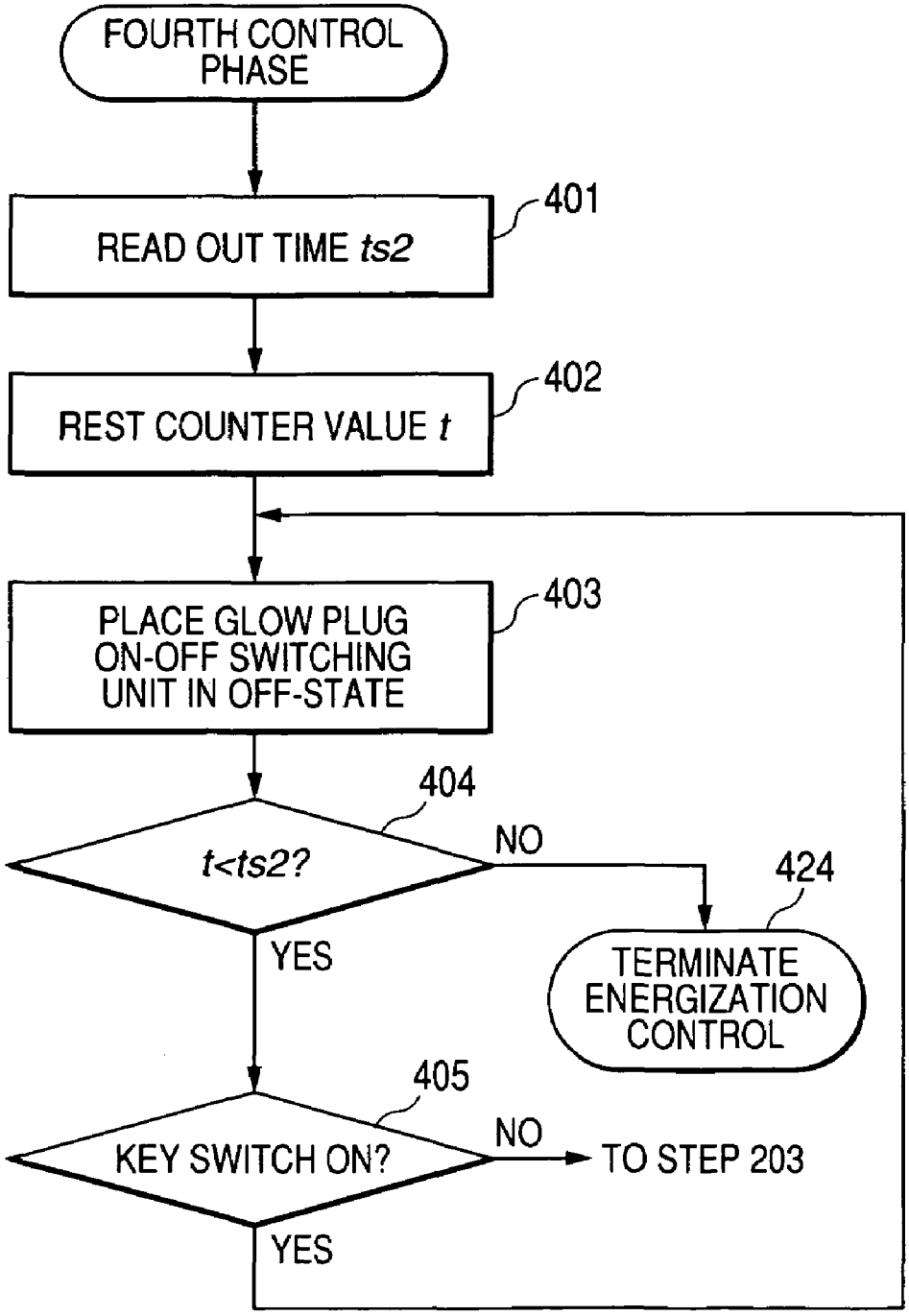
FIG. 6 shows a flowchart of a fourth control phase to control the state of a glow plug when a key switch is left on for power saving.

FIGS. 3 to 6 are flowcharts of logical steps or programs to be executed by the engine ECU 4 to control the operation of the glow plug 6. The program of FIG. 3 is to control initial energization of the glow plug 6. The program of FIGS. 4(*a*) and 4(*b*) is to control immediate reenergization of the glow plug 6 after the glow plug 6 reaches a target temperature. The program of FIGS. 5(*a*) and 5(*b*) is to control immediate reenergization of the glow plug 6 before the glow plug 6 reaches the target temperature. The program of FIG. 6 is to control the state of the glow plug 6 when the key switch 1 is left turned on.

Specifically, the control of energization of the glow plug 6 is broken down into four phases S1, S2, S3, and S4. When the key switch 1 is turned on by an operator, e.g., a driver of the vehicle, the engine ECU 4 is activated and enters the first control phase S1. When the engine ECU 4 has found the fact that the key switch 1 is turned on, the engine ECU 4 works to apply an effective voltage of, for example, 11V in the form of a PWM signal to the glow plug 6 to heat the glow plug 6 up to a target temperature T1 of, for example, 900° C. quickly. The engine ECU 4 continues to apply an effective voltage of, for example, 7V to the glow plug 6 to keep the target temperature T1 as it is and waits for a driver's start command, i.e., engine cranking. When the key switch 1 has been turned off after the glow plug 6 reaches the target temperature T1, the second control phase S2 is entered. When the driver turns on the key switch 1 again before the temperature of the glow plug 6 drops completely, the engine ECU 4 calculates an optimum reenergization duration for which the glow plug 6 is to be kept on or energized again and then energizes the glow plug 6 for the calculated duration. When the key switch 1 has been turned off before the glow plug 6 reaches the target temperature T1, the third control phase S3 is entered. When the driver turns on the key switch 1 again before the temperature of the glow plug 6 drops completely, the engine ECU 4 calculates an optimum reenergization duration for which the glow plug 6 is to be kept on or energized again and then energizes the glow plug 6 for the calculated duration. When the key switch 1 is kept on after expiry of a temperature-holding time during which the target temperature T1 of the glow plug 6 is to be kept as it is, the fourth control phase S4 is entered. The engine ECU 4 enters the power saving mode and turns off the glow plug 6 for power saving of the battery 3. This also avoids overheating of the glow plug 6. The first to fourth control phases S1 to S4 will be described below in detail.

The first control phase S1 includes a sequence of steps, as illustrated in FIG. 3.

First, in step 101, it is determined whether the voltage, as produced by the battery 3, is lower than or equal to a permissible upper limit or not. For instance, the upper limit is 14.5V in the case where the rated voltage of the battery 3 is 12V. If a NO answer is obtained meaning that the voltage of the battery 3 is higher than the upper limit, and a power supply system is malfunctioning, then the routine proceeds to step 120 wherein the power is inhibited from being supplied the glow plug 6, and this program is terminated. Alternatively, if a YES answer is obtained, then the routine proceeds to step 102 wherein a counter value t is reset to zero (0) and started to count the time. The routine proceeds to step 103 wherein the power to the glow plug on-off switching unit 5 is turned on. The routine proceeds to step 104 wherein an initial energization duration tp is calculated as a function of the temperature of coolant of the engine 2 using an initial energization map. Additionally, a temperature-holding time ta for which the target temperature T1 is to be held as it is also calculated as a function the temperature of coolant of the engine 2 using a temperature-holding time map. The initial energization map represents a relation between the temperature of coolant of the engine 2 and the initial energization duration tp, as prepared experimentally, and is stored in a memory built in the engine ECU 4. The temperature-holding time map represents a relation between the temperature of coolant of the engine 2 and the temperature-holding time ta, as prepared experimentally, and is stored in the memory of the engine ECU 4.

The routine proceeds to step 105 wherein it is determined whether the temperature of coolant of the engine 2 is lower than a given level (e.g., 40° C.) or not. If a YES answer is obtained, then the routine proceeds to step 106. Alternatively, if a NO answer is obtained, then the routine proceeds to step 121 to keep the glow plug 6 off. If the current execution cycle of step 105 is the second or subsequent cycle, the glow plug 6 may be placed in the on-state. In such an event, the glow plug 6 is brought into the off-state. Specifically, when the temperature of coolant of the engine 2 is already high, the engine ECU 4 determines that the engine 2 is now running, and there is no need for heating the engine 2 using the glow plug 6 and terminates the control of energization of the glow plug 6.

In step 106, it is determined whether the key switch 1 is in the on-state or not. If a YES answer is obtained, then the routine proceeds to step 108. Alternatively, if a NO answer is obtained, then the routine proceeds to step 107. In step 108, it is determined whether there is a need for energizing the glow plug 6 or not. Specifically, a determination is made whether the counter value t is smaller than the sum of the initial energization duration tp and the temperature-holding time ta, as determined in step 104, or not. If a YES answer is obtained, then the routine proceeds to step 110. Alternatively, if a NO answer is obtained, then the routine proceeds to step 109 wherein it is determined whether the engine is now running or not. If a YES answer is obtained meaning that there is no need for energizing the glow plug 6, then the routine proceeds to step 122 wherein the control of energization of the glow plug 6 is terminated. Alternatively, if a NO answer is obtained, then the routine proceeds to step 123 wherein the fourth control phase S4, as will be described later in detail, is entered for interrupting the power supply to the glow plug 6 for power saving of the battery 3.

In step 110, it is determined whether there is a need for achieving initial energization of the glow plug 6 or not. Specifically, a determination is made whether the counter value t is smaller than the initial energization duration tp or not. If a YES answer is obtained, then the routine proceeds to step 111 wherein the engine ECU 4 applies, as described above, an effective voltage of, for example, 11V to the glow plug 6. Alternatively, if a NO answer is obtained, then the routine proceeds to step 112 wherein the engine ECU 4 continues to apply an effective voltage of, for example, 7V to the glow plug 6 to keep the target temperature T1 as it is. After step 111 or 112, the routine returns back to step 105.

In step 107, it is determined whether the counter value t is smaller than the initial energization duration tp, as derived in step 104, or not. Specifically, a determination is made whether the glow plug 6 has not yet reached the target temperature T1 or not. If a NO answer is obtained meaning that the glow plug 6 has reached the target temperature T1, the routine proceeds to step 125 wherein the second control phase S2, as will be described later in detail, is entered. Alternatively, if a YES answer is obtained meaning that the glow plug 6 has not yet reached the target temperature T1, the routine proceeds to step 124 wherein the third control phase S3, as will be described later in detail, is entered.

FIGS. 4(*a*) and 4(*b*) show a sequence of steps of the second control phase S2 to be entered in step 125 of FIG. 3 when the key switch 1 has been turned off after the glow plug 6 reaches the target temperature T1. When the driver turns on the key switch 1 again before the temperature of the glow plug 6 drops completely, the engine ECU 4 calculates the optimum reenergization duration for which the glow plug 6 is to be kept on or energized again and then energizes the glow plug 6 for the calculated duration.

Specifically, in step 201, a time ts2 required until a brief reenergization control is unnecessary is read out of the memory of the engine ECU 4. The time ts2 is a fixed cooling time required by the glow plug 6 to cool from the target temperature T1 to an unoverheating upper limit T2. The unoverheating upper limit T2 is the temperature of the glow plug 6 (e.g., 550° C.) from which the glow plug 6 is permitted to be energized for the initial energization duration tp without overheating. The time ts2 is a value depending upon a combination of the engine 2 and the glow plug 6 and may be found experimentally.

The routine proceeds to step 202 wherein the counter value t is reset to zero (0) and started to count the time. The routine proceeds to step 203 wherein the glow plug on-off switching unit 5 is turned off to block the power supply to the glow plug 6. The routine proceeds to step 204 wherein it is determined whether the counter value t is smaller than the cooling time ts2, as derived in step 201, or not. Specifically, the engine ECU 4 monitors an off-period of time during which the power supply to the glow plug 6 is cut. If a YES answer is obtained meaning that the counter value t is smaller than the cooling time ts2, then the routine proceeds to step 205. Alternatively, if a NO answer is obtained meaning that the temperature of the glow plug 6 has decreased to a level which does not require the brief reenergization control, then the routine proceeds to step 224 to terminate the control of reenergization of the glow plug 6.

In step 205, it is determined whether the key switch 1 is turned on or not. If a NO answer is obtained, then the routine returns back to step 203. Alternatively, if a YES answer is obtained, then the routine proceeds to step 207 wherein a reenergization duration tpr2 is calculated according to an equation below. Additionally, the temperature-holding time ta for which the target temperature T1 is held is also calculated as a function the temperature of coolant of the engine 2 using the temperature-holding time map.

$$tpr2 = tp \times toff / ts2$$

where tp is the initial energization duration, as derived in step 104, toff is a time interval from turning off to turning on of the key switch 1, that is, the counter value t, and ts2 is the cooling time, as derived in step 201.

The routine proceeds to step 208 wherein the counter value t is reset to zero (0).

The routine proceeds to step 209, as illustrated in FIG. 4(*b*), wherein it is determined, like in step 101 of FIG. 3, whether the voltage, as produced by the battery 3, is lower than or equal to, for example, 14.5V or not. If a NO answer is obtained meaning that the voltage of the battery 3 is higher than the permissible upper limit, and a power supply system is malfunctioning, then the routine proceeds to step 225 wherein the power is inhibited from being supplied the glow plug 6, and this program is terminated. Alternatively, if a YES answer is obtained, then the routine proceeds to step 210 wherein it is determined whether the temperature of coolant of the engine 2 is lower than a given level (e.g., 40° C.) or not. If a NO answer is obtained, then the routine proceeds to step 226 to keep the glow plug 6 off. If the current execution cycle of step 210 is the second or subsequent cycle, the glow plug 6 may be placed in the on-state. In such an event, the glow plug 6 is brought into the off-state. Specifically, when the temperature of coolant of the engine is already high, the engine ECU 4 determines that the engine is now running, and there is no need for heating the engine using the glow plug 6 and terminates the control of reenergization of the glow plug 6.

The routine proceeds to step 211 wherein it is determined whether there is a need for energizing the glow plug 6 or not. Specifically, a determination is made whether the counter value t is smaller than the sum of the reenergization duration tpr2 and the temperature-holding time ta, as determined in step 207, or not. If a YES answer is obtained, then the routine proceeds to step 213. Alternatively, if a NO answer is obtained, then the routine proceeds to step 212 wherein it is determined whether the engine is now running or not. If a YES answer is obtained meaning that there is no need for energizing the glow plug 6, then the routine proceeds to step 227 wherein the control of reenergization of the glow plug 6 is terminated. Alternatively, if a NO answer is obtained, then the routine proceeds to step 228 wherein the fourth control phase S4, as will be described later in detail, is entered to interrupt the energization of the glow plug 6 for power saving of the battery 3.

In step 213, it is determined whether the counter value t is smaller than the reenergization duration tpr2 or not, that is, there is a need for achieving initial reenergization of the glow plug 6 or not. If a NO answer is obtained, then the routine proceeds to step 215. Alternatively, if a YES answer is obtained, then the routine proceeds to step 214 wherein the engine ECU 4 applies, as described above, an effective voltage of, for example, 11V to the glow plug 6. In step 215, the engine ECU 4 continues to apply an effective voltage of, for example, 7V to the glow plug 6 to keep the target temperature T1 as it is. After step 214 or 215, the routine proceeds to step 217 wherein it is determined whether the key switch 1 is in the on-state or not. If a YES answer is obtained, then the routine returns back to step 210. Alternatively, if a NO answer is obtained, then the routine proceeds to step 218 to check the temperature of the glow plug 6. Specifically, a determination is made whether the counter value t is smaller than the reenergization duration tpr2 or not. If a NO answer is obtained meaning that the glow plug 6 has already reached the target temperature T, then the routine returns back to step 201. Alternatively, if a YES answer is obtained meaning that the key switch 1 has been turned off before the glow plug 6 reaches the target temperature T, then the routine proceeds to step 229 to initiate the third control phase S3.

FIGS. 5(*a*) and 5(*b*) show a sequence of steps of the third control phase S3 to be entered in step 124 of FIG. 3 or step 229 of FIG. 4(*b*) when the key switch 1 has been turned off before the glow plug 6 reaches the target temperature T1. When the driver turns on the key switch 1 again before the temperature of the glow plug 6 drops completely, the engine ECU 4 calculates the optimum reenergization duration for which the glow plug 6 is to be kept on or energized again and then energizes the glow plug 6 for the calculated duration.

Specifically, in step 301, a time ts1 is determined that is a cooling time required by the glow plug 6 to drop from the temperature upon turning off of the key switch 1 to the unoverheating upper limit T2. Specifically, the cooling time ts1 is given by the following equation.

$$ts1 = ts2 \times ton/tp$$

where ts2 is the cooling time, as derived in step 201 of FIG. 4(*a*), ton is a period of time for which the key switch 1 is in the on-state during the initial energization duration tp, and tp is the initial energization duration, as derived in step 104 of FIG. 3.

The routine proceeds to step 302 wherein the counter value t is reset to zero (0) and started to count the time. The routine proceeds to step 303 wherein the glow plug on-off switching unit 5 is turned off to block the power supply to the glow plug 6. The routine proceeds to step 304 wherein it is determined whether the counter value t is smaller than the cooling time ts1, as derived in step 301, or not. Specifically, the engine ECU 4 monitors an off-period of time during which the power supply to the glow plug 6 is cut. If a YES answer is obtained meaning that the counter value t is smaller than the cooling time ts1, then the routine proceeds to step 305. Alternatively, if a NO answer is obtained meaning that the temperature of the glow plug 6 has decreased to a level which does not requires the reenergization control, then the routine proceeds to step 324 to terminate the reenergization control of the glow plug 6.

In step 305, it is determined whether the key switch 1 is turned on or not. If a NO answer is obtained, then the routine returns back to step 303. Alternatively, if a YES answer is obtained, then the routine proceeds to step 307 wherein a reenergization duration tpr1 is calculated according to an equation below. Additionally, the temperature-holding time ta for which the target temperature T1 is held is also calculated as a function the temperature of coolant of the engine 2 using the temperature-holding time map.

$$tpr1 = tp \times toff/ts1$$

where tp is the initial energization duration, as derived in step 104, toff is a time interval from turning off to turning on of the key switch 1, that is, the counter value t, and ts1 is the cooling time, as derived in step 301.

The routine proceeds to step 308 wherein the counter value t is reset to zero (0).

The routine proceeds to step 309, as illustrated in FIG. 5(*b*), wherein it is determined, like in step 101 of FIG. 3, whether the voltage, as produced by the battery 3, is lower than or equal to, for example, 14.5V or not. If a NO answer is obtained meaning that the voltage of the battery 3 is higher than the permissible upper limit, and the power supply system is malfunctioning, then the routine proceeds to step 325 wherein the power is inhibited from being supplied the glow plug 6, and this program is terminated. Alternatively, if a YES answer is obtained, then the routine proceeds to step 310 wherein it is determined whether the temperature of coolant of the engine 2 is lower than a given level (e.g., 40° C.) or not. If a NO answer is obtained, then the routine proceeds to step 326 to keep the glow plug 6 off. If the current execution cycle of step 310 is the second or subsequent cycle, the glow plug 6 may be placed in the on-state. In such an event, the glow plug 6 is brought into the off-state. Specifically, when the temperature of coolant of the engine is already high, the engine ECU 4 determines that the engine is now running, and there is no need for heating the engine using the glow plug 6 and terminates the control of reenergization of the glow plug 6.

The routine proceeds to step 311 wherein it is determined whether there is a need for energizing the glow plug 6 or not.

Specifically, a determination is made whether the counter value t is smaller than the sum of the reenergization duration tpr1 and the temperature-holding time ta, as determined in step 307, or not.

If a YES answer is obtained, then the routine proceeds to step 313. Alternatively, if a NO answer is obtained, then the routine proceeds to step 312 wherein it is determined whether the engine is now running or not. If a YES answer is obtained meaning that there is no need for energizing the glow plug 6, then the routine proceeds to step 327 wherein the control of reenergization of the glow plug 6 is terminated. Alternatively, if a NO answer is obtained, then the routine proceeds to step 328 wherein the fourth control phase S4, as will be described later in detail, is entered to interrupt the energization of the glow plug 6 for power saving of the battery 3.

In step 313, it is determined whether the counter value t is smaller than the reenergization duration tpr2 or not, that is, there is a need for achieving initial energization of the glow plug 6 or not. If a NO answer is obtained, then the routine proceeds to step 315. Alternatively, if a YES answer is obtained, then the routine proceeds to step 314 wherein the engine ECU 4 applies, as described above, an effective voltage of, for example, 11V to the glow plug 6. In step 315, the engine ECU 4 continues to apply an effective voltage of, for example, 7V to the glow plug 6 to keep the target temperature T1 as it is. After step 314 or 315, the routine proceeds to step 317 wherein it is determined whether the key switch 1 is in the on-state or not. If a YES answer is obtained, then the routine returns back to step 310. Alternatively, if a NO answer is obtained, then the routine proceeds to step 318 to check the temperature of the glow plug 6. Specifically, a determination is made whether the counter value t is smaller than the reenergization duration tpr2 or not. If a NO answer is obtained meaning that the glow plug 6 has already reached the target temperature T, then the routine returns back to step 301. Alternatively, if a YES answer is obtained meaning that the key switch 1 has been turned off before the glow plug 6 reaches the target temperature T, then the routine proceeds to step 329 to initiate the second control phase S2.

FIG. 6 shows a sequence of steps of the fourth control phase S4 to be entered in step 123 of FIG. 3, step 228 of FIG. 4(*b*), or step 328 of FIG. 5(*b*), when the key switch 1 is kept on after expiry of the temperature-holding time ta for which the target temperature T1 is to be held for saving the power of the battery 3.

First, in step 401, the time ts2 required until the brief reenergization control is unnecessary is, like in step 201 of FIG. 4(*a*), read out of the memory of the engine ECU 4.

The routine proceeds to step 402 wherein the counter value t is reset to zero (0) and started to count the time. The routine proceeds to step 403 wherein the glow plug on-off switching unit 5 is turned off to block the electric communication with the glow plug 6. The routine proceeds to step 404 wherein it is determined whether the counter value t is smaller than the cooling time ts2, as derived in step 401, or not. Specifically, the engine ECU 4 monitors an off-period of time during which the power supply to the glow plug 6 is cut. If a YES answer is obtained meaning that the counter value t is smaller than the cooling time ts2, then the routine proceeds to step 405. Alternatively, if a NO answer is obtained meaning that the temperature of the glow plug 6 has decreased to a level which does not requires the reenergization control, then the routine proceeds to step 424 to terminate the reenergization control of the glow plug 6.

In step 405, it is determined whether the key switch 1 is turned on or not. If a NO answer is obtained, then the routine returns back to step 203 in the second control phase S2. Alternatively, if a YES answer is obtained, then the routine returns back to step 403.

As apparent from the above discussion, the glow plug controller is so designed that when the key switch 1 is turned off and then on again after expiry of the initial energization duration tp, the optimum reenergization duration tpr2 may be derived as a function of a time interval between turning off and on of the key switch 1, or when the key switch 1 is turned off and then on again before expiry of the initial energization duration tp, the optimum reenergization duration tpr1 may be derived as a function of length of time the key switch 1 is in the on-state during the initial energization duration tp in order to avoid the overheating of the glow plug 6.

Figure 7A:
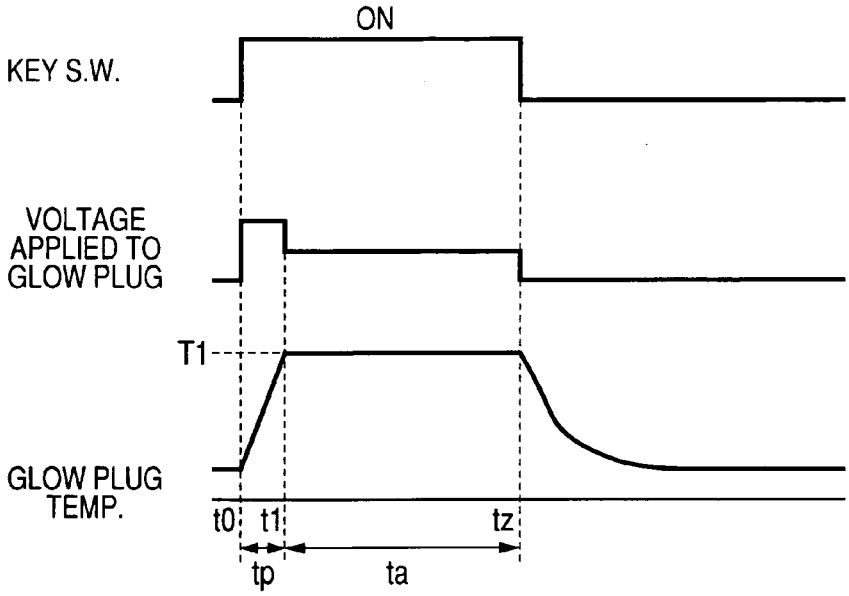
FIGS. 7(*a*) and 7(*b*) are timecharts which show examples of operations of the glow plug energization controller of FIG. 1.
Figure 7B:
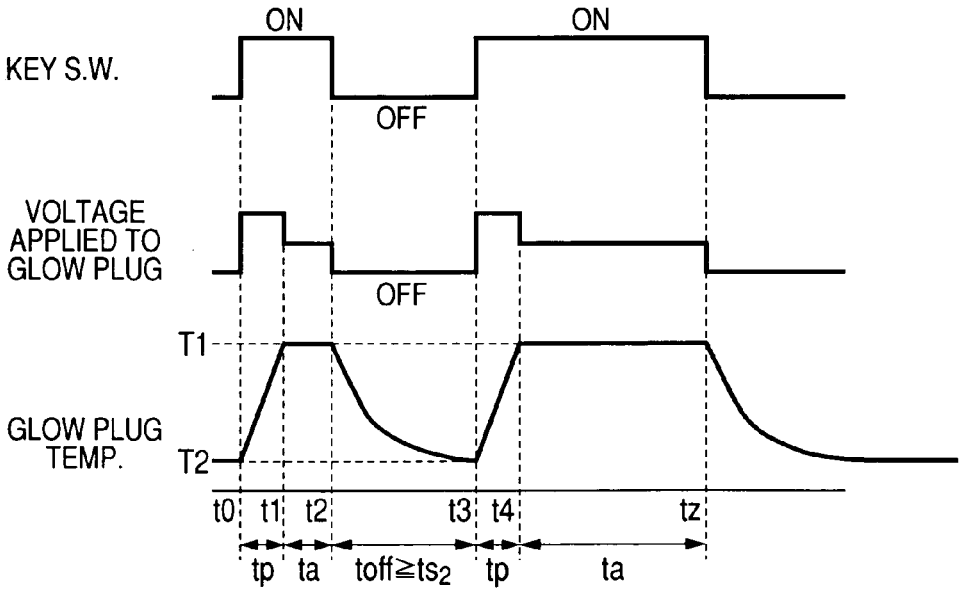

FIGS. 7(*a*) to 8(*b*) show examples of the above described operations of the engine ECU 4 to control the energization of the glow plug 6.

In the example of FIG. 7(*a*), when the key switch 1 is turned on at time t0, the engine ECU 4 supplies the power to the glow plug 6 until time t1 to heat it quickly to the target temperature T1. After time t1, the engine ECU 4 keeps the glow plug 6 energized to hold the target temperature T1 as it is until time tz.

In the example of FIG. 7(*b*), when the key switch 1 is turned on at time t0, the engine ECU 4 supplies the power to the glow plug 6 until time t1 (i.e., the initial energization duration tp) to heat it quickly to the target temperature T1. After time t1, the engine ECU 4 keeps the glow plug 6 energized to hold the target temperature T1 as it is. When the key switch 1 is turned off at time t2, the engine ECU 4 deenergizes the glow plug 6, so that the temperature of the glow plug 6 decreases. When the temperature of the glow plug 6 reaches the unoverheating upper limit T2 that is, as described above, the temperature of the glow plug 6 (e.g., 550° C.) from which the glow plug 6 is permitted to be heated for the initial energization duration tp without overheating, and the key switch 1 is turned on at time t3, the engine ECU 4 supplies the power to the glow plug 6 until time t4 (i.e., the initial energization duration tp) to heat it quickly to the target temperature T1 again. After time t4, the engine ECU 4 keeps the glow plug 6 energized to hold the target temperature T1 as it is until time tz. If a period of time required by the glow plug 6 to cool from the target temperature T1 to the unoverheating upper limit T2 is, as described above, defined as the cooling time ts2, the time interval toff between turning off (i.e., time t2) and turning on (i.e., time t3) of the key switch 1 is greater than the cooling time ts2. Specifically, at time t3, the temperature of the glow plug 6 has decreased sufficiently to a level which permits the glow plug 6 to be energized during a period of time tp that is identical with the initial energization duration tp without overheating.

Figure 8A:
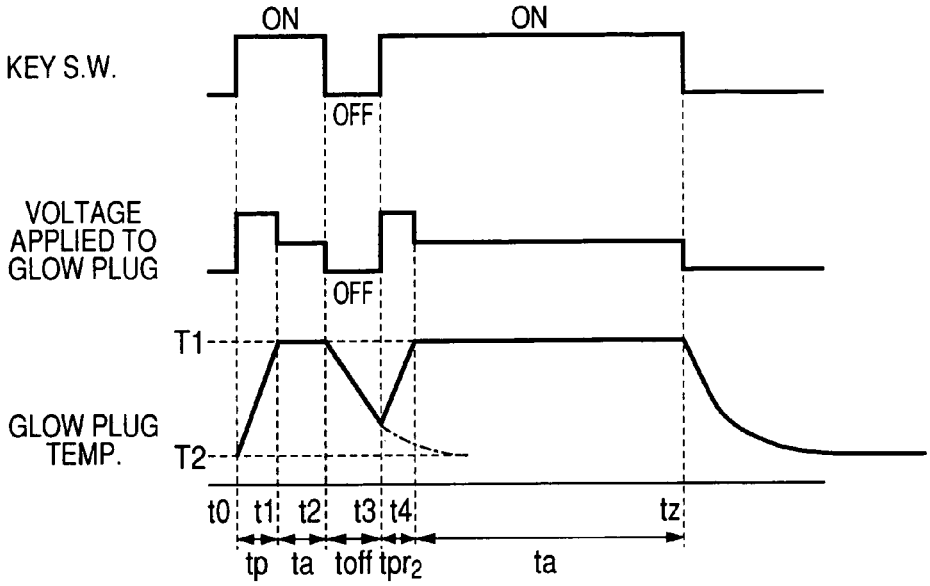
FIGS. 8(*a*) and 8(*b*) are timecharts which show examples of operations of the glow plug energization controller of FIG. 1.
Figure 8B:
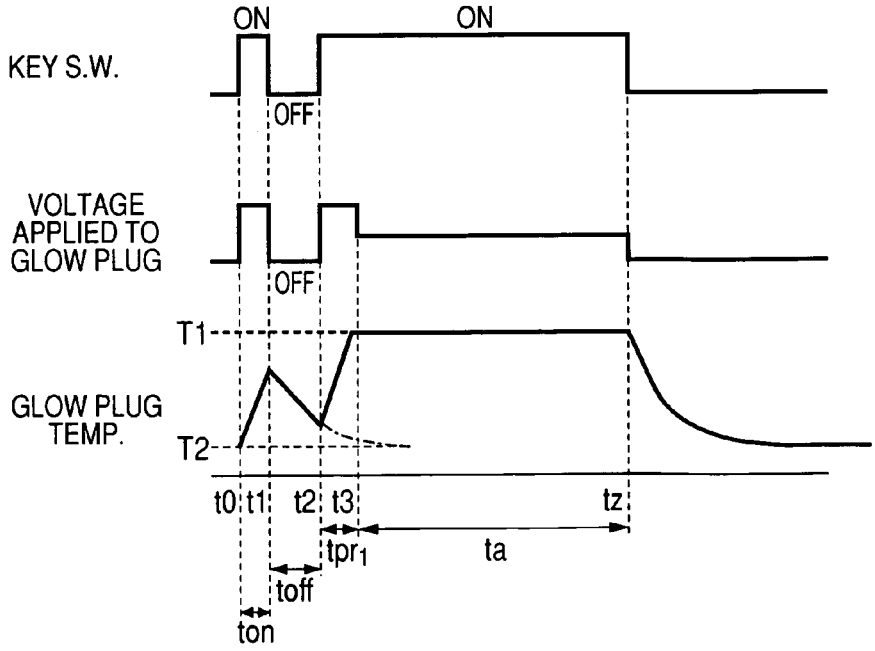

In the example of FIG. 8(*a*), when the key switch 1 is turned on at time t0, the engine ECU 4 supplies the power to the glow plug 6 until time t1 (i.e., the initial energization duration tp) to heat it quickly to the target temperature T1. After time t1, the engine ECU 4 keeps the glow plug 6 energized to hold the target temperature T1 as it is. When the key switch 1 is turned off at time t2, the engine ECU 4 deenergizes the glow plug 6, so that the temperature of the glow plug 6 decreases. When the key switch 1 is turned on again at time t3 before the temperature of the glow plug 6 reaches the unoverheating upper limit T2, the engine ECU 4 supplies the power to the glow plug 6 until time t4 (i.e., the reenergization duration tpr2) to heat it quickly to the target temperature T1. After time t4, the engine ECU 4 keeps the glow plug 6 energized to hold the target temperature T1 as it is until time tz. In this example, the time interval toff between turning off (i.e., time t2) and turning on (i.e., time t3) of the key switch 1 is shorter than the cooling time ts2. Specifically, at time t3, the temperature of the glow plug 6 has not yet decreased to the level which permits the glow plug 6 to be energized for the initial energization duration tp without overheating. Therefore, the engine ECU 4, as described above, calculates the reenergization duration tpr2 as a function of the off duration toff to avoid the overheating of the glow plug 6.

In the example of FIG. 8(*b*), when the key switch 1 is turned on at time t0, the engine ECU 4 supplies the power to the glow plug 6 to heat it quickly. When the key switch 1 is turned off at time t1, the engine ECU 4 deenergizes the glow plug 6, so that the temperature of the glow plug 6 decreases without reaching the target temperature T1. When the key switch 1 is turned on again at time t2, the engine ECU 4 supplies the power to the glow plug 6 until time t3 (i.e., the reenergization duration tpr1) to heat it quickly to the target temperature T1. After time t3, the engine ECU 4 keeps the glow plug 6 energized to hold the target temperature T1 as it is until time tz. If a period of time required by the glow plug 6 to drop from the temperature upon turning off of the key switch 1 (i.e., time t1) to the unoverheating upper limit T2 is, as described above, defined as the cooling time ts1, the off-duration toff is shorter than the cooling time ts1. Specifically, at time t2, the temperature of the glow plug 6 has not yet decreased to the level which permits the glow plug 6 to be energized for the initial energization duration tp without overheating. Therefore, the engine ECU 4, as described above, calculates the reenergization duration tpr1 as a function of the on duration ton that is a period of time (i.e., t0 to t1) for which the key switch 1 is in the on-state in order to avoid the overheating of the glow plug 6.

Figure 9A:
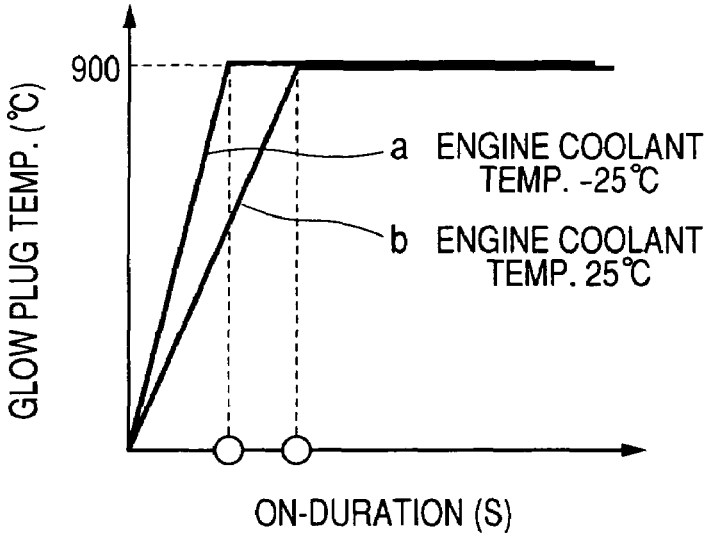
FIG. 9(*a*) is a graph showing an experimentally obtained relation between an on-duration of a glow plug and the temperature of the glow plug in terms of the temperature of coolant of an engine.
Figure 9B:
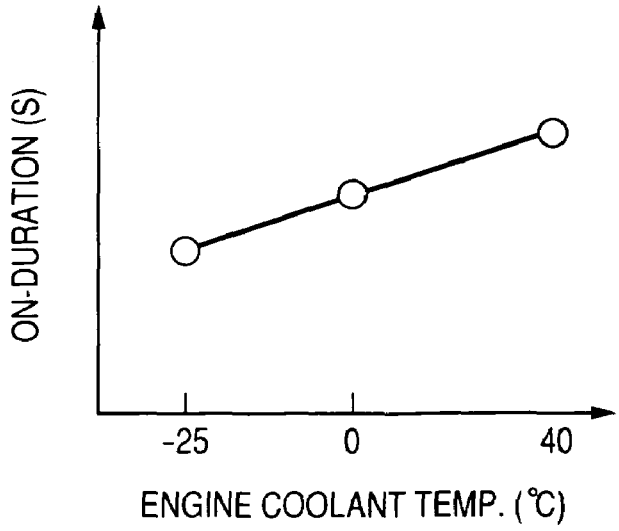

FIG. 9(*a*) is a graph showing an experimentally obtained relation between an on-duration (sec.) of the glow plug 6 and the temperature (° C.) of the glow plug 6 in terms of the temperature of coolant of the engine 2. The line a represents for the case where the temperature of coolant of the engine 2 is constant at −25° C. The line b represents for the case where the temperature of coolant of the engine 2 is constant at 25° C. The graph shows that the higher the temperature of coolant of the engine 2, the longer the on-duration of the glow plug 6 will be because the resistance of the glow plug 6 to current flow increases as the temperature of the engine 2 increases.

FIG. 9(*b*) is a graph plotting the on-duration of the glow plug, as illustrated in FIG. 9(*a*), which changes as a function of the temperature of coolant of the engine 2. The graph is stored in the ECU 4 as the initial energization map, as described above, for use in determining the initial energization duration tp for which the glow plug 6 is to be energized until the target temperature T1 (900° C.) is reached.

Figure 10:
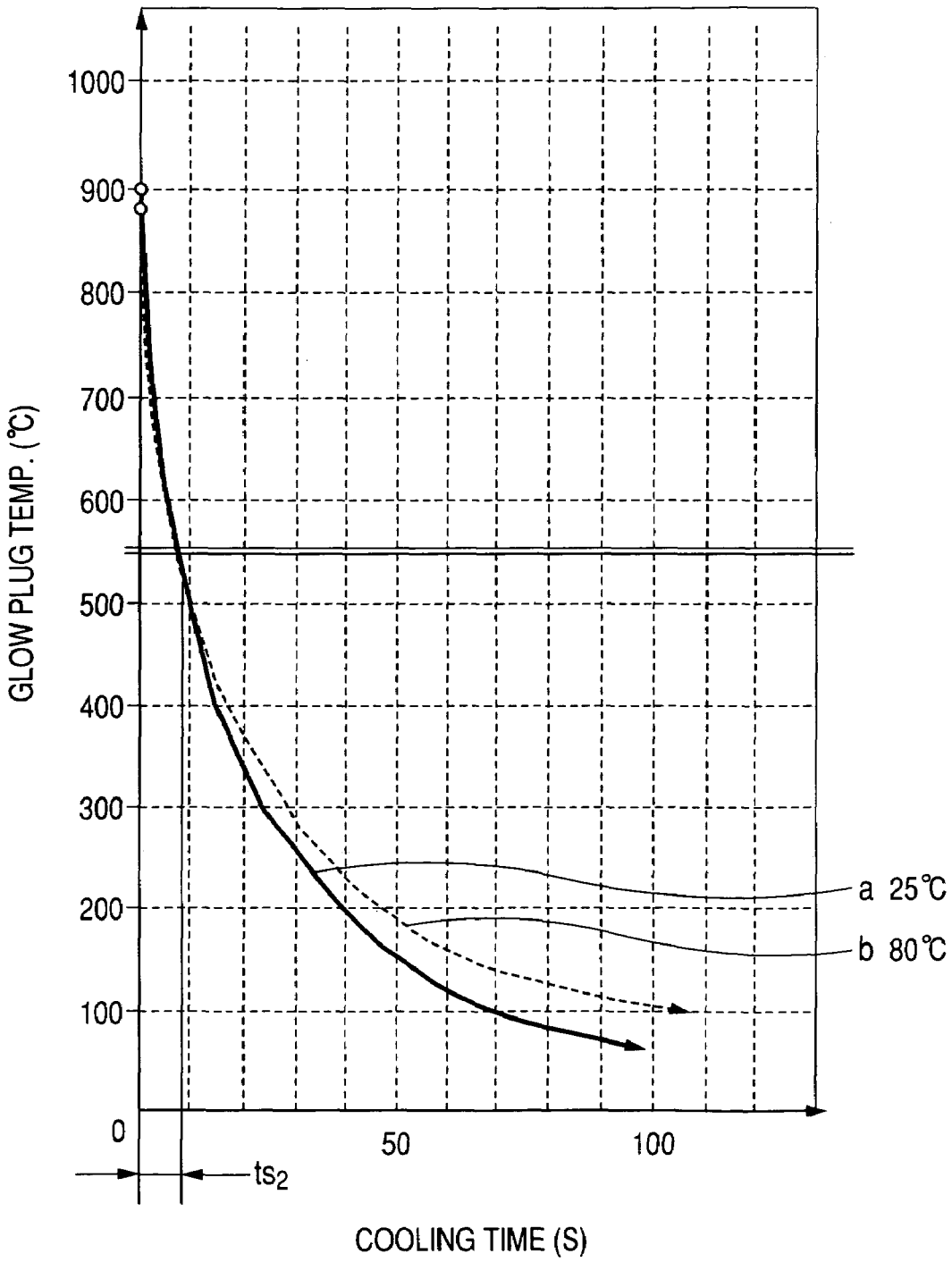
FIG. 10 is a graph which shows an experimentally obtained relation between a drop in temperature of a glow plug and the time (sec.) required for such a temperature drop.

FIG. 10 is a graph which shows an experimentally obtained relation between a drop in temperature (° C.)of the glow plug 6 and the time (sec.) required for such a temperature drop. The line a represents for the case where the temperature of coolant of the engine 2 is 25° C. meaning that the engine is cold. The line b represents for the case where the temperature of coolant of the engine 2 is 80° C. meaning that the engine is warmed up. The graph shows that the glow plug 6 cools from the target temperature T1 (900° C.) at substantially the same rate regardless of the temperature of coolant of the engine 2. A period of time required by the glow plug 6 to cool from the target temperature T1 (900° C.) to the unoverheating upper limit T2 (550° C.) is, as described above, stored as the cooling time ts2 in the engine ECU 4.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims. For example, the glow plug controller may be engineered to control energization of a plurality of glow plugs and also be implemented by a typical microcomputer instead of the engine ECU 4. In place of the temperature of coolant of the engine 4 used in determining the initial energization duration tp etc., the temperature of fuel, intake air, or exhaust air may be employed. The rated voltage of the battery 3 is not limited to 12V, but may be 24V.

What is claimed is:

1. A glow plug energization controlling apparatus comprising:

a power supply working to supply electric power to a glow plug mounted in an internal combustion engine;

an on-off switch working to produce a control trigger signal when turned on; and a controller including a microcomputer, said controller being responsive to the control trigger signal to control supply of the electric power from said power supply to energize the glow plug, the microcomputer working to monitor an off-on interval from turning off to turning on of said on-off switch and control an amount of energization of the glow plug as a function of the off-on interval, wherein the microcomputer monitors an switch on-duration for which said on-off switch is in an on-state and controls the amount of energization of the glow plug as a function of the switch on-duration.

2. A glow plug energization controlling apparatus as set forth in claim 1 wherein the microcomputer monitors a temperature parameter indicating a temperature of the engine and controls the amount of energization of the glow plug as a function of the temperature parameter.

3. A glow plug energization controlling apparatus as set forth in claim 2, wherein the microcomputer stores therein a first map representing an initial energization duration, for which the glow plug is to be energized until a target temperature is reached, defined as a function of the temperature of the engine, the microcomputer determining the initial energization duration by look-up using the first map based on the temperature parameter and energizing the glow plug for the initial energization duration.

4. A glow plug energization controlling apparatus as set forth in claim 3, wherein the microcomputer stores therein a second map representing a temperature-holding time, for which the target temperature is to be held constant after expiry of the initial energization duration, defined as a function the temperature of the engine, the microcomputer determining the temperature-holding time by look-up using the second map based on the temperature parameter and energizing the glow plug for the temperature-holding time after expiry of the initial energization duration.

5. A glow plug energization controlling apparatus as set forth in claim 3, wherein if a temperature of the glow plug from which the glow plug is permitted to be energized for the initial energization duration without overheating is defined as an unoverheating temperature, the microcomputer stores therein a cooling time that is a time required by the glow plug to cool from the target temperature to the unoverheating temperature, and wherein, when said on-off switch is turned off after the glow plug reaches the target temperature, the microcomputer is in a reset mode for the cooling time unless the on-off switch is turned on.

6. A glow plug energization controlling apparatus as set forth in claim 5, wherein when said on-off switch is turned off and then on after the glow plug reaches the target temperature, the microcomputer calculates a reenergization duration tpr2 for which the glow plug is to be energized according to an equation below $$tpr2=tp\times toff/ts2$$

where tp is the initial energization duration, toff is the off-on interval, and ts2 is the cooling time, and wherein the microcomputer energizes the glow plug for the reenergization duration.

7. A glow plug energization controlling apparatus as set forth in claim 5, wherein when said on-off switch is turned off before the glow plug reaches the target temperature, the microcomputer calculates a second cooling time ts1 according to an equation below $$ts1=ts2\times ton/tp$$

where ts2 is the cooling time required by the glow plug to cool from the target temperature to the unoverheating temperature, ton is a period of time for which said on-off switch is in the on-state during the initial energization duration, and tp is the initial energization duration, and wherein the microcomputer is in the reset mode for the second cooling time ts1 unless the on-off switch is turned on.

8. A glow plug energization controlling apparatus as set forth in claim 7, wherein when said on-off switch is turned off and then on before the glow plug reaches the target temperature, the microcomputer calculates a reenergization duration tpr1 for which the glow plug is to be energized according to an equation below $$tpr1=tp\times toff/ts1$$

where tp is the initial energization duration, toff is a time interval from turning off to turning on of said on-off switch, and ts1 is the second cooling time, and wherein the microcomputer energizes the glow plug for the reenergization duration tpr1.

9. A glow plug as in claim 1 wherein:

when a preselected period of time expires after said on-off switch is turned off, said controller (a) determines that the glow plug has dropped in temperature to a predetermined value and (b) deactivates control of the amount of glow plug energization based on the off-on duration and the on-duration when said on-off switch is subsequently turned on.

10. A glow plug energization controlling method of controlling energization of a glow plug mounted in an internal combustion engine, comprising:

a first step of sampling a parameter indicating a temperature of the engine upon turning on of an on-off switch designed to produce a control trigger signal when turned on, finding an initial energization during for which the glow plug is to be energized until a target temperature is reached by look-up using a first map representing the initial energization duration defined as a function of the temperature of the engine, energizing the glow plug for the initial energization duration, and keeping the glow plug at the target temperature for a given temperature-holding time after expiry of the initial energization duration;

a second step of finding a cooling time ts2 required by the glow plug to cool from the target temperature to an unoverheating temperature from which the glow plug is permitted to be energized for the initial energization duration without overheating, blocking supply of power to the glow plug when the on-off switch is turned off after expiry of the initial energization duration during the first step, and entering a rest mode to place the glow plug in an off-position until expiry of the cooling time ts2 unless the on-off switch is turned on; and a third step of, when the on-off switch is turned on again during the second step, calculating a reenergization duration tpr2 for which the glow plug is to be energized as a function of an off-on interval from turning off to turning on of the on-off switch, energizing the glow plug for the reenergization duration tpr2, and keeping a temperature of the glow plug constant for the temperature-holding time after expiry of the reenergization duration tpr2.

11. A glow plug energization controlling method as set forth in claim 10, wherein the reenergization duration tpr2 is given by an equation below $$tpr2=tp\times toff/ts2$$

where tp is the initial energization duration, toff is the off-on interval, and ts2 is the cooling time.

12. A glow plug energization controlling method as set forth in claim 10, further comprising a fourth step of, when the on-off switch is turned off during the first step before expiry of the initial energization duration, sampling the parameter indicating the temperature of the engine, calculating a second cooling time ts1 required by the glow plug to cool to the unoverheating temperature, and entering a rest mode unless the on-off switch is turned off and a fifth step of, when the on-off switch is turned on again during the fourth step, calculating a reenergization duration tpr1 for which the glow plug is to be energized as a function of an on-duration for which the on-off switch is in an on-state during the initial energization duration, energizing the glow plug for the reenergization duration tpr1, and holding the temperature of the glow plug for the temperature-holding time after expiry of the reenergization duration tpr1.

13. A glow plug energization controlling method as set forth in claim 12, wherein the second cooling time ts1 is given by an equation below $$ts1=ts2\times ton/tp$$

where ts2 is the cooling time required by the glow plug to cool from the target temperature to the unoverheating temperature, ton is the on-duration for which the on-off switch is in the on-state during the initial energization duration, and tp is the initial energization duration.

14. A glow plug energization controlling method as set forth in claim 13, wherein the reenergization duration tpr1 is given by an equation below $$tpr1=tp\times toff/ts1$$

where tp is the initial energization duration, toff is a time interval from turning off to turning on of the on-off switch, and ts1 is the second cooling time.

15. A glow plug energization controlling method as set forth in claim 10, further comprising a fourth step of finding the cooling time ts2 required by the glow plug to cool from the target temperature to the unoverheating temperature and, when the on-off switch is kept on after expiry of the temperature-holding time, deenergizing the glow plug until the cooling time ts2 expires unless the on-off switch is turned off, a fifth step of, when the on-off switch is turned off during the fourth step, entering the rest mode during the cooling time ts2 following the fourth step unless the on-off switch is turned on again, and a sixth step of, when the on-off switch is turned on again during the fifth step, calculating the reenergization duration tpr2 for which the glow plug is to be energized as a function of the off-on interval from turning off to turning on of the on-off switch, and energizing the glow plug for the reenergization duration tpr2.

* * * * *